US007498497B2

(12) United States Patent
Ito

(10) Patent No.: US 7,498,497 B2
(45) Date of Patent: Mar. 3, 2009

(54) BODY STRUCTURE OF STRINGED INSTRUMENT

(75) Inventor: Osamu Ito, Tokyo (JP)

(73) Assignee: Yamaha Corporation, Shizuoka (JP)

( * ) Notice: Subject to any disclaimer, the term of this patent is extended or adjusted under 35 U.S.C. 154(b) by 297 days.

(21) Appl. No.: 11/224,858

(22) Filed: Sep. 13, 2005

(65) Prior Publication Data

US 2006/0054000 A1 Mar. 16, 2006

(30) Foreign Application Priority Data

Sep. 15, 2004 (JP) ..... 2004-267756

(51) Int. Cl.
*G10D 3/00* (2006.01)

(52) U.S. Cl. ..... 84/291; 84/297 R

(58) Field of Classification Search ..... 84/291, 84/293, 297, 314 R, 324 R
See application file for complete search history.

(56) References Cited

U.S. PATENT DOCUMENTS 3,915,049 A * 10/1975 Bean ..... 84/743
4,031,799 A * 6/1977 Fender ..... 84/307
4,290,336 A * 9/1981 Peavey ..... 84/291
6,011,205 A * 1/2000 Tucker et al. ..... 84/291

FOREIGN PATENT DOCUMENTS

JP 63-170696 7/1988

* cited by examiner

*Primary Examiner*—Walter Benson
*Assistant Examiner*—Jianchun Qin
(74) *Attorney, Agent, or Firm*—William L. Androlia; H. Henry Koda

(57) ABSTRACT

A body structure of a stringed instrument is designed to reduce weight and to improve sound quality with respect to a solid body, which is constituted by a core material and a pair of decorative boards, wherein the core material is composed of a single material having a relatively low specific gravity (e.g., 0.4 or less) such as falcata, bass wood, and balsa, while the decorative boards each have hardness greater than that of the core material. The core material has curved flatness (or curvature) in which both sides lying in the width thereof are reduced in thickness compared with the center portion thereof. The core material having a relatively low specific gravity is sandwiched between the hard decorative boards; hence, it is possible to reduce the overall weight while securing satisfactory strength.

2 Claims, 2 Drawing Sheets

BODY STRUCTURE OF STRINGED INSTRUMENT

BACKGROUND OF THE INVENTION

1. Field of the Invention

This invention relates to body structures of stringed instruments, and in particular to body structures of electric stringed instruments such as electric guitars having solid bodies.

This application claims priority on Japanese Patent Application No. 2004-267756, the content of which is incorporated herein by reference.

2. Description of the Related Art

It is well known that electric stringed instruments such as electric guitars have solid bodies in which a plurality of wooden sheets are adhered together to form prescribed planar shapes. However, solid bodies of electric guitars have relatively heavy weight compared with hollow bodies of acoustic guitars; hence, they may cause physically heavy burden for players who play guitars.

In order to reduce the weight of a guitar body, Japanese Unexamined Patent Publication No. S63-170696 discloses an example of a body structure of an electric stringed instrument that uses light wooden members for prescribed parts. This body structure is designed such that plural types of wooden materials are adhered together in the same plane so as to form a single body block, which is then subjected to cutting at the outer periphery thereof and is thus transformed into a prescribed shape. In the body block, mahogany is used in the center portion in which strings are stretched under tension, while balsa and mahogany are used in the peripheral portion. This may achieve satisfactory strength in prescribed parts of the body while reducing the overall weight of the body to some extent.

The aforementioned body structure uses body blocks, in which plural types of wooden materials are adhered together, as constituent materials of a body of an electric stringed instrument. This requires a primary step for forming wooden materials into a prescribed shape, and a secondary step for adhering blocks together. For this reason, the aforementioned body structure merely results in complication of manufacturing.

In the aforementioned body structure, mahogany (i.e., hard wooden material) is used in the center portion for arranging pickups and the peripheral portion of a body. That is, relatively heavy wooden material such as mahogany is used in the center portion and peripheral portion of a body; hence, it is difficult to reduce the overall weight of the body.

Manufacturers may generally consider that overall weight of wooden manufactured products can be reduced by using wooden materials having low specific gravity or low weight. However, this may lead to another problem in that wooden materials having low specific gravity or low weight are reduced in strength or hardness. In other words, the demand for reducing weight conflicts with the demand for securing satisfactory strength through hardening. Therefore, it is strongly demanded for manufacturer to develop a body structure of a stringed instrument that satisfies both of the aforementioned demands.

SUMMARY OF THE INVENTION

It is an object of the present invention to provide a body structure of a stringed instrument, which is reduced in weight so as to reduce burden for a player playing the stringed instrument.

It is another object of the present invention to provide a body structure of a stringed instrument, in which disadvantages caused by reduction of weight, such as a reduction of strength or hardness, can be avoided and in which resonance similar to that produced by a hollow body can be realized in a solid body so as to produce superior performance when playing the stringed instrument.

According to the present invention, a body structure of a stringed instrument includes a solid-type core material and at least one decorative board that is attached to one side of the core material, wherein the hardness of the decorative board is greater than that of the core material. In addition, the core material is formed using a single material whose specific gravity is lower than that of the decorative material. Furthermore, at least one side of the core material is curved in the periphery thereof.

Specifically, as the core material, it is possible to use a single material, whose specific gravity is 0.4 or less, that is selected from among falcata, bass wood, and balsa. When the core material is applied to a solid body of an electric guitar (in which length lies along the neck, and width crosses the length at a right angle in the same plane), it is preferable for the core material to have so-called "curved flatness" (or curvature) in which both sides lying in the width are gradually reduced in thickness compared with the center portion. Herein, the maximum thickness measured at the center portion of the core material may range from 30 mm to 55 mm, for example. The minimum thickness measured at both ends of the core material may range from 10 mm to 30 mm, for example. Thus, even when the outer periphery of the core material is exposed to the exterior, it is possible to reduce the exposed area of the core material; hence, it is possible to secure satisfactory strength while reducing weight for a body of a stringed instrument.

The decorative board is formed using a hard wood such as maple whose specific gravity is greater than that of the core material. In order to reduce the overall weight of a body of a stringed instrument using the aforementioned core material, it is preferable for the decorative material to have a prescribed thickness, which may range from 2 mm to 6 mm, for example. Thus, it is possible to secure satisfactory strength for a body and required strength for fixing parts to the body. Incidentally, the decorative board can be shaped in such a way that the peripheral portion thereof is gradually reduced in thickness compared with the center portion thereof.

Because the core material is formed using a single material whose specific gravity is lower than that of the decorative board, it is possible to reduce the overall weight of the solid body of the stringed instrument. Herein, both sides of the core material having a relatively low weight are respectively covered with decorative boards, wherein it is possible to reinforce the core material so as to secure satisfactory strength, and it is also possible to produce resonance similar to that of a hollow body. In addition, the decorative boards can secure satisfactory strength in fixing parts of a stringed instrument thereto.

Moreover, the peripheral portion of the body is curved; hence, it is possible to ease physical resistance that is caused when a player's arm comes into contact with the exterior surface of the body; therefore, it is possible to improve performability when playing a stringed instrument.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
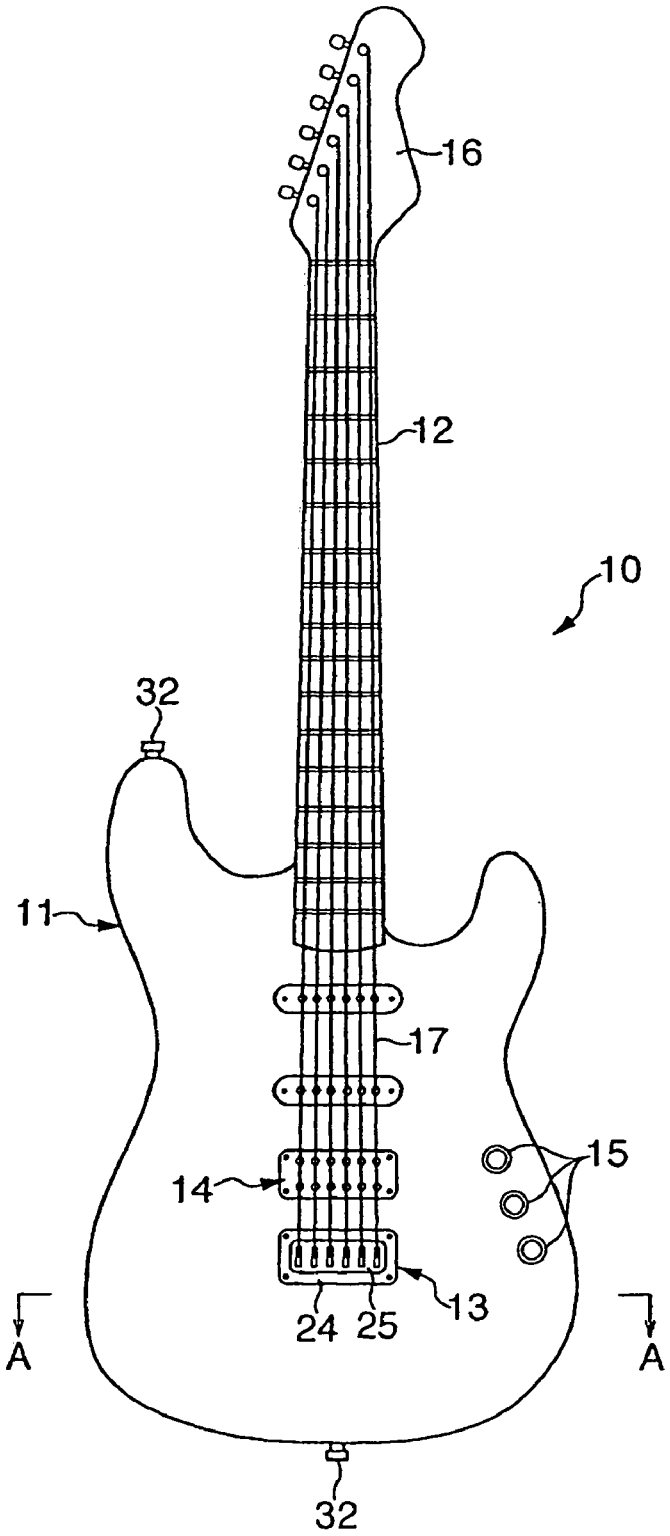
FIG. 1 is a front view showing the exterior appearance of an electric guitar having a body structure of a stringed instrument in accordance with a preferred embodiment of the present invention.
Figure 2A:
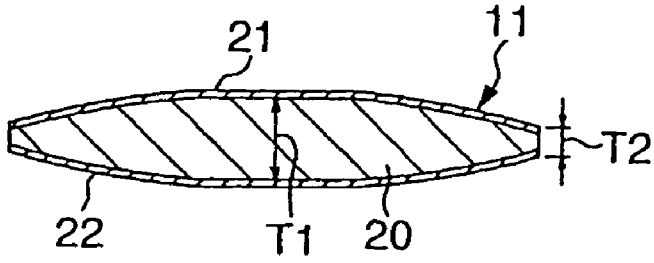
FIG. 2A is a cross-sectional view taken along line A-A in FIG. 1.
Figure 2B:
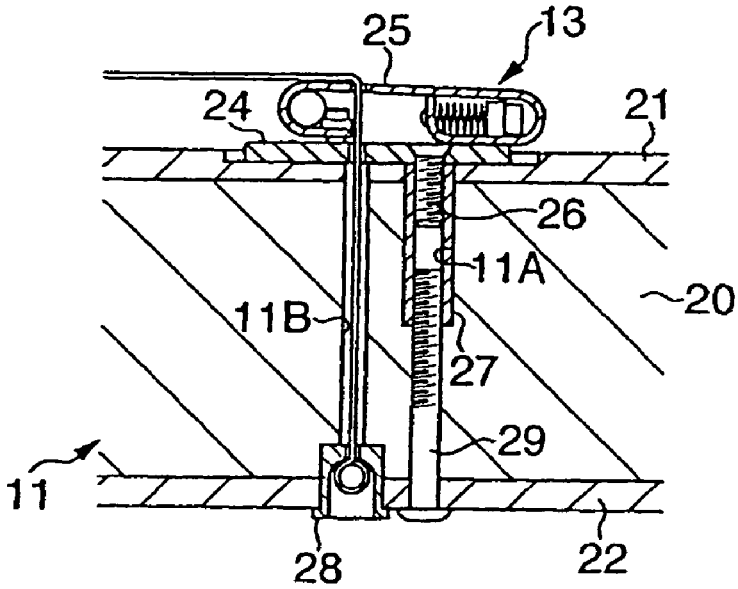
FIG. 2B is an enlarged cross-sectional view showing an internal mechanism adapted to a bridge assembly of the electric guitar shown in FIG. 1.
Figure 2C:
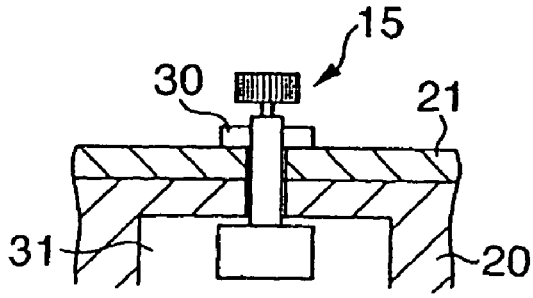
FIG. 2C is an enlarged cross-sectional view showing an attachment mechanism adapted to a control attached to the electric guitar shown in FIG. 1.

FIG. 1 is a front view showing the exterior appearance of an electric guitar using a body structure of a stringed instrument in accordance with a preferred embodiment of the present invention. FIGS. 2A to 2C are fragmentary cross-sectional views of the electric guitar shown in FIG. 1.

In FIG. 1, an electric guitar 10 is constituted by a body 11, a neck 12 that is interconnected to and extends from the body 11, a bridge assembly 13 that is arranged at a prescribed position on the front side of the body 11, pickups 14, controls 15 (i.e., wheels or knobs serving as a volume control and tone controls), a head 16 that is interconnected to the top end of the neck 12, and a plurality of strings 17 that are stretched under tension between the bridge assembly 13 and tuning pegs of the head 16.

As shown in FIG. 2A in which the body 11 lies horizontally so that the front side thereof is illustrated at the top and the backside is illustrated at the bottom, the body 11 is constituted by a solid-type core material 20, a front-side decorative board 21 that is attached to the front side of the solid-type core material 20, and a backside decorative board 22 that is attached to the backside of the solid-type core material 20. A single material is used for the core material 20 and is selected from among prescribed materials whose specific gravity is 0.4 or less, such as falcata, bass wood, and balsa. The core material 20 is formed using body material blocks (not shown), each of which is formed by adhering wooden materials (each having 10 cm of width or so) in both of the thickness direction and width direction, wherein the front sides, backsides, and peripheral surfaces of the body material blocks are subjected to cutting, so that the core material 20 as a whole has curved flatness (or curvature) in which both ends thereof (lying in the width corresponding to the left and right directions in FIG. 1) are reduced in thickness compared to the center portion thereof. Herein, the maximum thickness T1 of the core material 20 (i.e., the thickness of the center portion) is set to approximately 45 mm, while the minimum thickness T2 (i.e., the thickness of both ends lying in the width) is set to 14 mm, for example. The core material 20 is curved with a prescribed radius of curvature so as to secure a strengthening effect, wherein the radius of curvature may range from 600 mm to 2000 mm, for example.

The decorative boards 21 and 22 are respectively fixed to the front side and backside of the core material 20 by use of adhesive. In the present embodiment, maple is selected as an example of heavy wood whose specific gravity is greater than that of the core material 20 and is used for the decorative boards 21 and 22. Each of the decorative boards 21 and 22 has a thickness that is set to approximately 4 mm, for example, whereby it is possible to secure satisfactory strength or hardness for holding the bridge assembly 13 and the pickups 14.

FIG. 2B shows the details of the bridge assembly 13 in which a base 24 is arranged on the front-side decorative board 21; a string receiver 25 is attached onto the upper surface of the base 24; and the base 24 is fixed to the front-side decorative board 21 by use of a screw, which is screwed into the backside of the base 24. In addition, an internally threaded bushing 27 is inserted into a through hole 11A that is formed at a prescribed position to run through the body 11 in the thickness direction and the crew 26 is screwed into an upper portion thereof; a string stopper 28 is arranged in the lower end of a string passage 11B, which is formed adjacent to the through hole 11A, so that one end of a string is stopped by the string stopper 28 at the backside of the body 11; and a bolt 29 is screwed into the lower portion of the internally-threaded bushing 27 from the backside of the body 11 so that the bolt 29 is securely interconnected with the internally-threaded bushing 27. Due to the aforementioned fixing structure shown in FIG. 2B, it is possible to secure satisfactory fixing strength with respect to the bridge assembly 13. No illustration is provided, but the pickups 14 are also fixed to the body 11 similarly to the bridge assembly 13 fixed to the body 11 as shown in FIG. 2B. As shown in FIG. 2C, each of the controls 15 (e.g. volume and tone controls) is fixed onto the front-side decorative board 21 via a nut 30, wherein reference numeral 31 designates a recess or a hollow that is formed inside of the body 11 or the core material 20.

As described above, the present embodiment is characterized in that the core material 20 has specific gravity that is 0.4 or less, while the decorative boards 21 and 22 each have a greater specific gravity; hence, it is possible to reduce the overall weight of the body 11. In addition, a unique traverse cross-sectional shape having curved flatness is applied to the body 11 in which both sides lying in the width are reduced in thickness compared with the center portion, whereby it is possible to reduce the total exposed area of the periphery of the core material 20, and it is possible to maintain satisfactory strength of the body 11 due to the provision of the decorative boards 21 and 22. Due to the adhesion of the decorative boards 21 and 22 that are adhered to the front side and backside of the core material 20, it is expected that the solid body can realize vibration causing resonance, which can be conventionally produced in a hollow-type body; hence, it is possible to produce good sound quality.

The present invention is not necessarily limited to the present embodiment described with reference to the accompanying drawings showing specific structural features, and these features should not be interpreted as restricting ones. That is, it is possible to provide various modifications without departing from the technological concept and objective of the present invention, wherein the body structure of a stringed instrument can be modified in terms of dimensions and shape as well as positional and directional arrangement of parts.

For example, the present embodiment shows that the core material 20 is exposed to the exterior at the peripheral surfaces thereof (corresponding to the side ends thereof), which is not a restriction in the present invention. That is, it is possible to adhere hard materials to the peripheral surfaces of the core material 20 as long as a required reduction of the overall weight of the body 11 can be secured. In this case, it is possible to further increase the overall strength (or rigidity) of the body 11, wherein it is also possible to increase the strength for attaching a pin 32 (see FIG. 1), which is engaged with one end of a shoulder strap (not shown). In addition, it is possible to use a porous material such as a resin foaming material for the core material 20.

The present invention is not necessarily limited to electric guitars; hence, it can be applied to other types of stringed instruments such as acoustic guitars.

The present embodiment shows a symmetrically curved shape of the body 11, which may be symmetrically curved in both the left and right as well as the top-bottom. Of course, it is possible to modify the overall shape of the body 11, so that the backside is made flat and the front side only is curved, and in which the peripheral portion or a part of the peripheral portion only is curved, for example. In summary, the body structure of a stringed instrument can be appropriately modified in terms of dimensions, shape, and other structural factors within the scope of the invention as long as it satisfies both the demand for reducing weight and the demand for securing satisfactory strength so as to highly secure and improve the performability and sound quality in playing the stringed instrument.

What is claimed is:

1. A body structure of a stringed instrument, comprising:

a wood core material;

one decorative wood board attached to one side of the core material, in which the decorate board has hardness that is greater than that of the wood core material, and a second wood board having substantially the same properties as said one decorative wood board attached to a back side of said wood core material, a bridge threadably coupled to said body structure from a back side of said body structure by means of a through hole in said one decorative wood board, wood core and second wood board of said body structure and a bolt passing through said through hole from said back side of said body structure and threadably coupled to said bridge, and wherein the wood core material is formed using a single material whose specific gravity is lower than that of the one decorative wood board and said second wood board; and said bridge is threadably coupled to said body by first screw means treaded through said bridge and into said through hole, an internally threaded bushing provided in said through hole with said first screw means treaded there into and a second screw means inserted into said through hole from a back side of said body structure and threaded into said bushing.

2. The body structure according to claim 1, wherein pick-ups are secured to said body of said stringed instrument in substantially the same manner as said bridge.

* * * * *